United States Patent [19]

Liao

[11] Patent Number: 4,941,225

[45] Date of Patent: Jul. 17, 1990

[54] AUTOMATIC CHALK-POWDER COLLECTING DEVICE FOR BLACKBOARD ERASER

[76] Inventor: Su-Land Liao, No.13, Lane 200 Shihtung Load, Shihlin District, Taipei, Taiwan

[21] Appl. No.: 436,009

[22] Filed: Nov. 13, 1989

[51] Int. Cl.[5] ..... A47L 13/38; B43L 21/00

[52] U.S. Cl. ..... 15/98; 15/27; 15/221; 15/99; 15/210 R; 434/417

[58] Field of Search ..... 15/23, 24, 27, 97 R, 15/98, 99, 210 R, 221; 434/417

[56] References Cited

U.S. PATENT DOCUMENTS

| | | | |
|---|---|---|---|
| 4,596,059 | 6/1986 | Lee | 15/98 |
| 4,642,831 | 2/1987 | Roth | 15/99 |
| 4,742,594 | 5/1988 | Chen | 15/98 |

FOREIGN PATENT DOCUMENTS

| | | | |
|---|---|---|---|
| 2090123 | 7/1982 | United Kingdom | 15/210 R |

*Primary Examiner*—Harvey C. Hornsby
*Assistant Examiner*—Gary Graham
*Attorney, Agent, or Firm*—Young & Forward

[57] ABSTRACT

This invention relates to an automatic chalk-powder collecting device for blackboard eraser; it mainly comprises a body portion, two symmetrical side covers, a powder box, and a powder-collecting assembly. By means of the aforesaid structure and a one-way brake switch in the powder-collecting assembly, the rollers of this invention are controlled to rotate in one direction only. When the present invention is erasing a blackboard back and forth same as a conventional eraser does, the chalk powder on the rubbing cloth can be cleaned automatically and simultaneously. It is deemed that the present invention has greatly improved the drawbacks of the conventional eraser, which must be beaten or cleaned repeatedly in use to cause a lot of powder flying in the air.

2 Claims, 3 Drawing Sheets

AUTOMATIC CHALK-POWDER COLLECTING DEVICE FOR BLACKBOARD ERASER

BACKGROUND OF THE INVENTION

In schooling, the teachers usually give explanation to students with blackboard, i.e., a teacher would write what is to teach on a blackboard during the class hours. Since the available space of a blackboard is limited for the unlimited subject matters, the teacher has to repeatedly erase the subjects on the blackboard already explained so as to give space to the next subject. After each erasing, a large quantity of chalk powder will be left on the eraser; then, the eraser has to be cleaned; otherwise, the eraser would be unable to erase the blackboard efficiently, and a large quantity of chalk powder would fall and fly in the air after each erasing motion. The flying chalk powder would jeopardize a person's lungs (It is reported that teachers would have over ten times of possibility to suffer from pulmonary emphysema than other people). Moreover, whenever a large amount of flying chalk powder falls on one's face, hairs and hands, it would be rather difficult to clean, and it would cause a bad appearance to a person. In order to avaid such a case, the teacher has to remove the powder on the eraser repeatedly. When the teacher cleans an eraser, it would also cause the powder to fly in the air. This chalk powder problem has annoyed the teachers for many years; this problem has recently been improved by means of a chalk-powder cleaning machine; unfortunately, that machine has to be operated with electric power, and that requirement causes another inconvenient drawback during practical use in classroom; therefore, the present invention is developed to improve the aforesaid drawback.

SUMMARY OF THE INVENTION

This invention relates to an automatic chalk-powder collecting device for blackboard eraser; it mainly comprises a body portion, two symmetrical side covers, a powder box, and a powder-collecting assembly. By means of the aforesaid structure and a one-way brake switch in the powder-collecting assembly, the rollers of this invention are controlled to rotate in one direction only. When the present invention is erasing a blackboard back and forth same as a conventional eraser does, the chalk powder on the rubbing cloth can be cleaned automatically and simultaneously. It is deemed that the present invention has greatly improved the drawbacks of the conventional eraser, which must be beaten or cleaned repeatedly in use to cause a lot of powder flying in the air.

BRIEF DESCRIPTION OF THE DRAWINGS:

FIG. 2—1 is a perspective view of a bristle base plate of the present invention.

Figure 1:
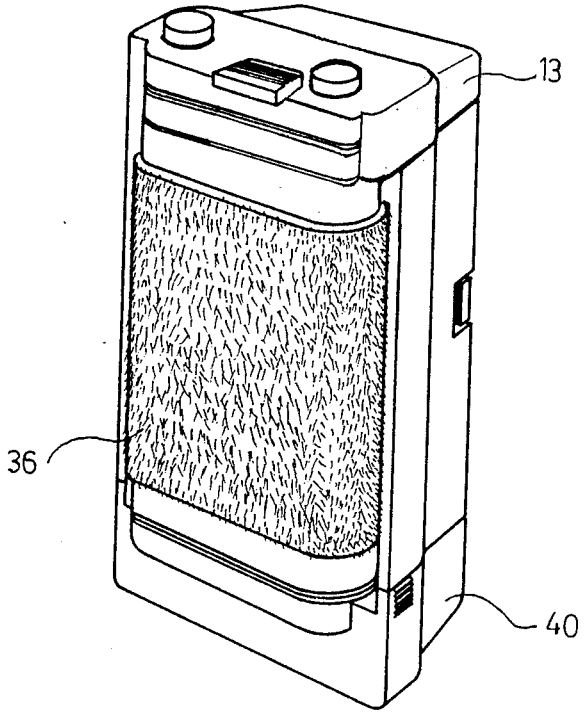
FIG. 1 is a perspective view of an embodiment according to the present invention.
Figures 1, 2:
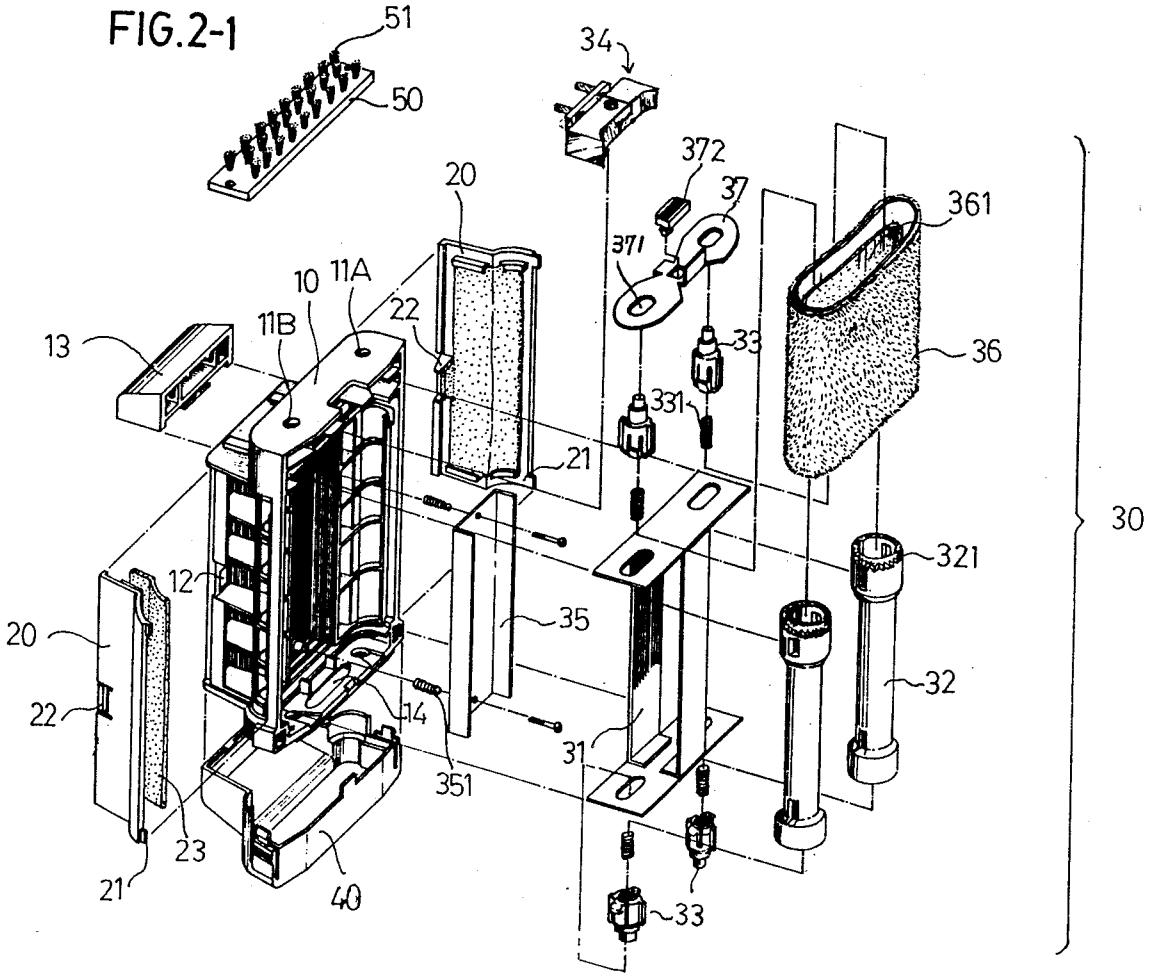
FIG. 2 is a disassembled view of the present invention.

DETAILED DESCRIPTION OF THE INVENTION:

Referring to FIGS. 1 and 2, there shows the present invention mainly comprising a body portion(10), two symmetrical side covers(20), a powder-collecting assembly(30), and a detachable powder box(40).

The body portion(10) is a hollow case, of which the top and bottom are furnished with two symmetrical shaft holes(11A) and(11B) respectively for mounting two rollers(32) in the aforesaid powder-collecting assembly(30). The present invention has two symmetrical side covers(20), of which each has a flange(21) and a fastening hook(22) to be engaged with the fastening hole(12) on the edge of the body portion(10) so as to have the side covers(20) mounted on the body portion(10) respectively. Both the body portion(10) and the two side covers(20) are formed into a handle of the present invention during using the eraser.

Figure 4:
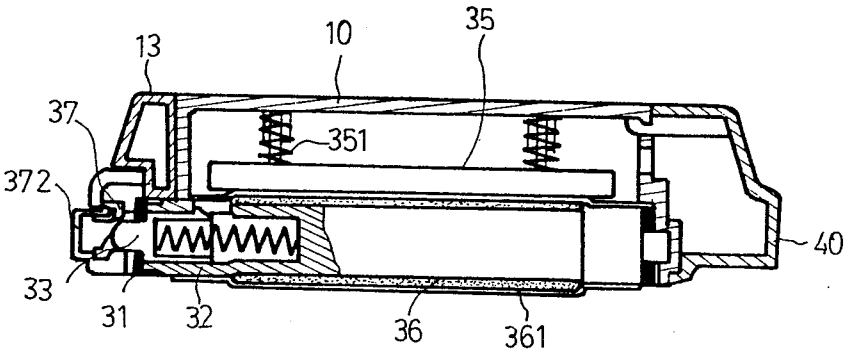
FIG. 4 is a sectional view from one side of the present invention.
Figure 3:
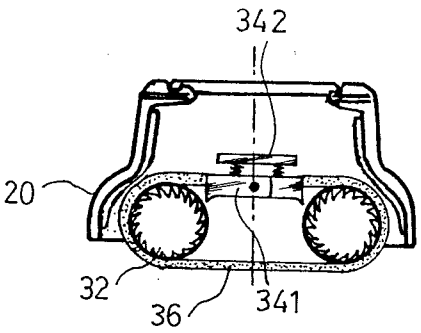
FIG. 3 is a sectional view of the one-way switch according to the present invention.

The powder-collecting assembly(30) of the present invention includes a fixing frame(31), a pair of rollers(32), two pairs of terminal shafts(33) to be mounted to both ends of the two rollers(32) respectively, a set of one-way brake switch(34) and a scraper(35). Referring to FIGS. 2, 3 and 4, the powder-collecting assembly(30) of the present invention is to be assembled by steps as follows: Mount the rubbing cloth(36) on the two rollers(32), and mount the terminal shafts(33) with compression springs(331) on the ends of the rollers(32) respectively so as to have the terminal shafts(33) and the rollers(32) put under a spring-load condition to facilitate the assembling and disassembling operation between the rollers(32) and the fixing frame(31). The top of the fixing frame(31) is mounted with a horizontal plate(37) that has two holes(371) for holding two terminal shafts(33) respectively. The middle part of the horizontal plate(37) is furnished with a pressing plate(372), whereby the terminal shafts(33) can be pushed downwards to disengage from the shaft holes(11A) and(11B) on the body portion(10) so as to detach the rollers(32), to replace the rubbing cloth(36) and other related parts.

Referring to FIGS. 2 and 3, there shows a body portion(10) being mounted with a set of one-way brake switch(34), which includes two summetrical hooks pawls(341) mounted on a slidable seat(342). The one-way brake switch(34) is coupled to a control handle(13). Under normal condition, the two hook detents(341) are not engaged with the two ratchet wheels(321) on the top ends of the two rollers(32) respectively, and therefore the rubbing cloth can be ratated freely with the rollers (32); in that case, it is unable to rub the chalk powder on the blackboard. Whenever the control handle(13) is pushed to left or right side (up to one's usage), the slidable seat(342) will be moved to the same side as the control handle(13) does to cause the hook detents(341) to be engaged with the ratchet wheels(321) respectively; in this case, the rollers(32) can rotate in one direction only. Whenever the rollers are held in place by the hook pawl without rotating, the rubbing cloth would have much friction force to be applied to the surface of the blackboard so as to erase the chalk-powder thereon. When the rollers rotate in opposite direction, the rollers will not be detained by the hook detents, i.e., the rollers can rotate in one direction freely so as to let the rubbing cloth convey the chalk powder thereon into the body portion(10); the chalk powder on the rubbing cloth will be scraped off by a scraper(35) mounted inside the body portion. The chalk powder scraped off will fall into a through hole(14) on the bottom of th ebody portion and finally fall into a detachable powder box(40) under the body portion(10). The rest chalk powder flying inside the body portion(10) would be absorbed by two wet cotton pads(23) mounted on the two side covers(20) respectively. After the eraser being used for a given period of time, the detachable powder box(40) and the cottom pads(23) should be removed and cleaned so as to facilitate teh next erasing operation.

The rubbing cloth(36) as shown in FIG. 1 is made of a cloth that is full of fiber gaps or easy to absorb chalk powder. The inner surface of the rubbing cloth is attached with a lining(361), which is to be mounted around the mid and smaller diameter portion of the rollers(32) so as to facilitate the rubbing cloth(36) to move together with the rollers(32).

The scraper(35) behind the rubbing cloth(36) is mounted with several springs(351) so as to have it become closely contacted with the rubbing cloth(36) for scraping off the chalk powder completely.

Referring to FIG. 2—1, there shows a bristle base plate(50), which is used for replacing the scraper(35); the bristle base plate(50) is planted with many bristles(51), which are to be in close contact with the rubbing cloth(36) so as to scrape off the chalk powder on the rubbing cloth upon the cloth passing through the bristles(51), and to prevent the top layer powder from flying in the air (because of the top layer powder having less adhesive force, and being easy to fly into the air). Therefore, the present invention may be operated on a blackboard in a manner same as that of a conventional blackboard eraser. By means of the one-way brake switch and the powder box, the present invention can automatically remove the chalk powder on the rubbing cloth upon erasing the blackboard back and forth, and the present invention has greatly improved the drawbacks of the conventional blackboard eraser, which must be beaten or cleaned the powder after every use; in that case, the chalk powder would fly in the air.

Briefly, since the present invention has an automatic device to collect the chalk powder, it is deemed a new device being practical in use, and being simple in structure; therefore, it is considered a novel and effective eraser, being much better than the conventional eraser.

I claim:

1. An automatic chalk-powder collecting device for blackboard eraser mainly comprising a body portion, two symmetrical side covers, a powder-collecting assembly, and a detachable powder box;

said body portion being substantially a hollow case, and the top and bottom of said body portion being provided with two opposite shaft holes for mounting two rollers respectively; and the bottom of said body portion being furnished with several through holes to facilitate chalk powder to fall into a powder box under said body portion;

said two symmetrical side covers being mounted on both sides of said body portion, and each of said side covers being mounted with a wet cotton pad for collecting any chalk powder flying inside said body portion;

said powder-collecting assembly including a fixing frame, a pair of rollers, two pairs of terminal shafts being mounted on both ends of said rollers, a one-way brake switch having two hook detents, and a scraper for scraping chalk powder; and the outside of said rollers being mounted with a rubbing cloth; and both ends of said rollers being mounted with terminal shafts and compression springs respectively; and the top end of said fixing frame being mounted with a horizontal plate, of which the middle part is provided with a pressing plate for pushing downwards said horizontal plate and said terminal shafts so as to have said rollers disassembled easily; and each top end of said rollers being furnished with a ratchet wheel to be engaged with the two hook detents of said one-way brake switch; and said one-way brake switch being coupled with a control handle so as to control said brake switch to move leftwards or rightwards and to let said rollers rotate one way; and when said rollers being engaged with said hook detents, said rollers being unable to rotate, the friction force between a blackboard and said rubbing cloth being increased so as to rub off the chalk powder thereon; and when said rollers rotating in one direction, most of the chalk powder can be scraped off by said scraper.

2. An automatic chalk-powder collecting device for blackboard eraser as claimed in claim 1, wherein said scraper is replaced with a bristle base plate which is planted with a plurality of bristles, and said bristles are set in close contact with the surface of said rubbing cloth.

* * * * *